US012497790B2

(12) United States Patent
Dalla Fontana

(10) Patent No.: US 12,497,790 B2
(45) Date of Patent: Dec. 16, 2025

(54) SUPPORTING HEAD FOR PROVIDING FORMWORK UNITS FOR FLOOR SLABS, AND BEAM AND PANEL FOR USE WITH THE SUPPORTING HEAD

(71) Applicant: FARESIN FORMWORK S.P.A., Breganze (IT)

(72) Inventor: Giacomo Dalla Fontana, Breganze (IT)

(73) Assignee: FARESIN FORMWORK S.P.A., Breganze (IT)

( * ) Notice: Subject to any disclaimer, the term of this patent is extended or adjusted under 35 U.S.C. 154(b) by 176 days.

(21) Appl. No.: 18/267,866

(22) PCT Filed: Dec. 16, 2021

(86) PCT No.: PCT/EP2021/086288
§ 371 (c)(1),
(2) Date: Jun. 16, 2023

(87) PCT Pub. No.: WO2022/129395
PCT Pub. Date: Jun. 23, 2022

(65) Prior Publication Data

US 2024/0052650 A1 Feb. 15, 2024

(30) Foreign Application Priority Data

Dec. 17, 2020 (IT) ..... 102020000031187
Nov. 25, 2021 (IT) ..... 102021000029789

(51) Int. Cl.
*E04G 11/48* (2006.01)
*E04G 11/50* (2006.01)

(52) U.S. Cl.
CPC ..... *E04G 11/483* (2013.01); *E04G 11/50* (2013.01)

(58) Field of Classification Search
CPC ..... E04G 11/483; E04G 11/50; E04G 11/38; E04G 9/02; E04G 11/48
See application file for complete search history.

(56) References Cited

U.S. PATENT DOCUMENTS 5,614,122 A 3/1997 Schworer
2004/0075042 A1* 4/2004 Arozena Bergaretxe ..... E04G 11/486 249/28

(Continued)

FOREIGN PATENT DOCUMENTS

DE 4305302 A1 8/1994
EP 3202998 A1 8/2017

(Continued)

OTHER PUBLICATIONS

International Search Report dated Mar. 28, 2022 issued in PCT/EP2021/086288.

(Continued)

*Primary Examiner* — Gisele D Ford
(74) *Attorney, Agent, or Firm* — Scully, Scott, Murphy & Presser, P.C.

(57) ABSTRACT

A supporting head for providing formwork units for floor slabs, to a beam and to a panel for use with the supporting head;

the supporting head comprises, with respect to a position for use thereof:

a substantially horizontal lower plate, an upper plate which is parallel to the lower plate and spaced apart therefrom, a first plate and a second plate, which are arranged in a cross and protrude upward from the upper plate with pairs of vertical protrusions which are adapted (Continued)

to define and/or delimit resting regions for supporting beams and/or for panels.

12 Claims, 12 Drawing Sheets

(56) References Cited

U.S. PATENT DOCUMENTS

| | | | | |
|---|---|---|---|---|
| 2018/0340342 | A1* | 11/2018 | Lizarazu Zaldua | E04G 11/38 |
| 2019/0010716 | A1* | 1/2019 | Baron | E04G 25/061 |
| 2019/0010717 | A1* | 1/2019 | Baron | E04G 11/52 |
| 2019/0112824 | A1 | 4/2019 | Charitou | |
| 2019/0277044 | A1* | 9/2019 | Faresin | E04G 11/486 |
| 2020/0173183 | A1* | 6/2020 | Routh | E04G 11/38 |
| 2021/0079670 | A1* | 3/2021 | Becker | E04G 11/38 |

FOREIGN PATENT DOCUMENTS

| | | | |
|---|---|---|---|
| ES | 1043112 | U | 11/1999 |
| WO | 2011089148 | A1 | 7/2011 |

OTHER PUBLICATIONS

Written Opinion dated Mar. 28, 2022 issued in PCT/EP2021/086288.

Italian Search Report and Written Opinion dated Aug. 25, 2021 issued in IT 202000031187, with partial translation.

* cited by examiner

SUPPORTING HEAD FOR PROVIDING FORMWORK UNITS FOR FLOOR SLABS, AND BEAM AND PANEL FOR USE WITH THE SUPPORTING HEAD

The present invention relates to a supporting head for providing formwork units for floor slabs, a beam and a panel for use with the supporting head.

The invention can be applied in construction, in the sector of apparatuses for construction.

In the provision of floor slabs the use is widespread of supporting heads, of the fixed type or of the drop type (adapted to be removed from below after the concrete is cast), for at least one supporting beam of a formwork panel to be installed above a prop resting on the ground. Typically, in the lower part, the head has a plate from which a shank protrudes in a downward region, to be inserted into the prop, which is tubular, and at the upper end of the prop there is a complementary plate on which the head is locked to the prop, by joining the two plates by bolting.

According to some drop head solutions, this comprises two plates arranged mirror-symmetrically and laterally adjacent to mutually opposite sides of an upright fixed to the upper end of the prop. The plates have recesses for resting the ends of the beams. A head of this type can support two contiguous supporting beams, arranged on opposite sides with respect to the upright. In such case, the beams face each other with a space between them that is equal at least to the thickness of the upright. The spacing apart also determines an empty space between two contiguous panels mounted above the beams, which typically is filled using a filling element, to be installed above the upright, which is adapted to prevent the concrete from falling during the step of casting.

The fixed supporting heads have a part for resting the beam with upward protrusions, sometimes contoured, which are adapted to be inserted into the slots present in the lower part of the beam.

Such fixed supporting heads can typically be used for supporting a single supporting beam, proximate to the end thereof or in an intermediate region, located close to a similar, contiguous beam, in order to position contiguous panels in mutual contact above the beams. With the fixed head, since there is no upright, the distance that would remain between the contiguous panels cannot be filled with filling elements.

Another limitation of fixed heads lies in the fact that they cannot support more than two beams and therefore during the preparation of the structure it is not possible to make a frame with crossed beam junctions, making it necessary to use two supporting heads to change the direction of the framework.

Also, another limitation lies in not being able to use the supporting heads to support the panels directly, without interposition of the beams, for some types of construction work such as compensations near a wall.

The aim of the present invention is to provide a supporting head, of fixed type, which is capable of improving the known art in one or more of the above mentioned aspects.

Within this aim, an object of the invention is to provide a supporting head with which it is possible to rest beams both at the ends and in intermediate zones and in multiple directions.

Another object of the invention is to provide a supporting head by virtue of which it is possible to overlay contiguous panels in mutual contact on the beams.

A further object of the invention is to provide a supporting head that allows an easy positioning of the beams, at the ends, in intermediate regions and in multiple directions, and a likewise easier removal thereof during the step of dismantling.

Another object of the present invention is to overcome the drawbacks of the known art in a different manner to any existing solutions.

Another object of the invention is to provide a supporting head that is highly reliable, easy to implement and low cost.

This aim and these and other objects which will become better apparent hereinafter are achieved by a supporting head for providing formwork units for floor slabs, which is characterized in that it comprises, with respect to its position for use:

- a substantially horizontal lower plate,
- an upper plate which is parallel to the lower plate and spaced apart therefrom,
- a first plate and a second plate, which are arranged in a cross and protrude upward from said upper plate with pairs of vertical protrusions which are adapted to define and/or delimit resting regions for supporting beams and/or for panels.

The present invention also relates to a beam for providing formwork units for floor slabs, to be used with the supporting head, characterized in that it comprises a profiled element at the ends of which there is a pair of plate-like elements which are parallel on a vertical plane, with respect to the installation position of said beam, between which there is a transverse rod with which said beam is rested on a resting region of one of said first plate and said second plate.

The present invention also relates to a panel for providing formwork units for floor slabs, to be used with the supporting head, characterized in that it has at least one opening in the lower part which is adapted to receive portions of said beam or of said supporting head.

Further characteristics and advantages of the invention will become better apparent from the detailed description that follows of a preferred, but not exclusive, embodiment of the supporting head according to the invention, which is illustrated for the purposes of non-limiting example in the accompanying drawings wherein.

Figure 1:
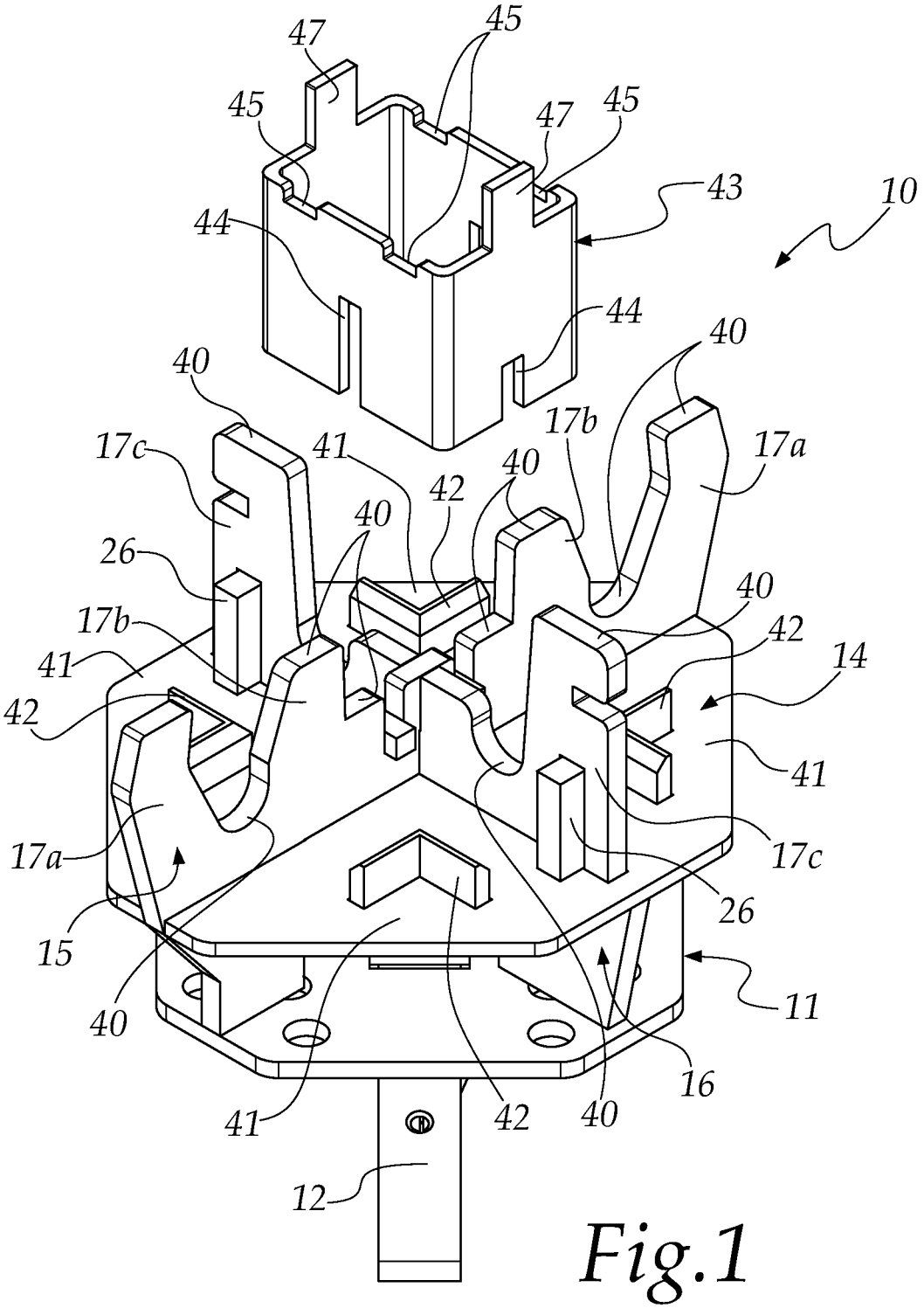
FIG. 1 is a partially exploded perspective view of a supporting head, in a first embodiment thereof, according to the invention.

With reference to the figures, the supporting head according to the invention, of fixed type, generally designated by the reference numeral 10 in a first embodiment thereof, comprises, with respect to its position for use:

- a substantially horizontal lower plate 11, from which a shank 12 protrudes in a downward region which is adapted to be inserted into a supporting prop 13 resting on the ground,
- an upper plate 14, which is parallel to, spaced apart from and rendered integral with the lower plate 11,
- a first plate 15 and a second plate 16, which are vertical and arranged in a cross and protrude upward from the upper plate 14 with pairs of vertical protrusions 17*a*, 17*b*, 17*c* which are adapted to define and/or delimit resting regions 40 for supporting beams 18 and/or for panels 19.

The vertical protrusions 17*a*, 17*b*, 17*c* have a flat upper edge on which to rest supporting beams 18.

The shank 12 is open on opposite sides and with it the head 10 can be inserted from above into the corresponding prop 13 which has at its top a complementary plate with an opening for inserting the shank 12. The lower plate 11 is designed to be fixed by bolting to the complementary plate.

Inside the shank 12 there is a coupling device 20, conventional per se and constituted by two elements 20*a* and 20*b* which are pivoted to each other and to the shank 12 on the pin 21. Such elements are associated with elastic means (preferably a torsion spring) in order to enable snap-acting engagement thereof with the lower plate 11. In particular, they have a respective upper tooth 22 (indicated in FIG. 5), with which they protrude upward from a hole 23 on the lower plate 11, on which they abut.

Figure 2:
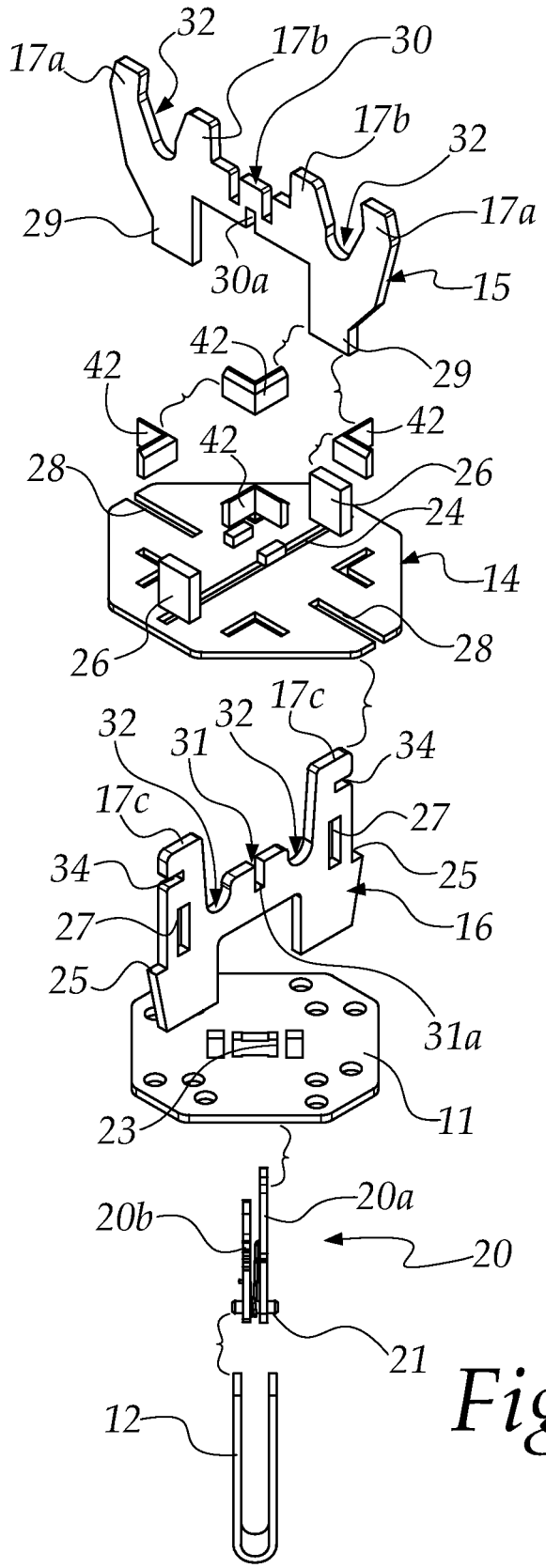
FIG. 2 is another exploded perspective view of a head according to the invention.

From the exploded view of FIG. 2 it is possible to see the shape of the individual components of the supporting head 10 and the manner and order in which they are assembled.

In particular, the second plate 16 is welded in a vertical position on the lower plate 11. The upper plate 14 is positioned above the second plate 16 in the horizontal position, parallel to the lower plate 11, and is passed through by a portion of second plate 16 at a central slot 24. The second plate 16 protrudes from the upper plate 14 with the protrusions 17*c*, as can be seen in FIG. 1.

Also, the second plate 16 has two shoulders 25 on which the upper plate 14 rests. There is also a pair of platelets 26, to be inserted transversely to the second plate 16 in special openings 27, after the positioning of the upper plate 14, in order to prevent its displacement before welding.

The upper plate 14 also has two aligned cuts 28, which are open outward and in a direction perpendicular to that of the slot 24. The first plate 15, with two respective lower portions 29, is inserted from above through such cuts 28, to be welded on the lower plate 11.

The first plate 15 and the second plate 16 also have a central portion, respectively 30 and 31, above the upper plate 14, where they respectively have a downward opening 30*a* and an upward opening 31*a* in which they are coupled by intersecting.

The first plate 15 has a first pair of vertical protrusions 17*a*, which are mutually opposite so as to delimit between them a resting region 40 for a supporting beam 18, and a second pair of vertical protrusions 17*b*, which are more internal than the first pair of protrusions 17*a*, so as to define therewith mutually opposite recesses 32 for guiding the insertion of respective resting portions 33 of corresponding supporting beams 18.

To simplify the illustrations, the resting regions 40 are indicated in FIG. 1, while the recesses 32 are indicated in FIG. 2, although these also define resting regions 40 for the beams.

The second plate 16 also has a pair of mutually opposite recesses 32 which are delimited externally by a pair of vertical protrusions 17*c* for guiding the insertion of respective resting portions 33 of corresponding supporting beams 18.

Each vertical protrusion 17*c* of the second plate 16 has a transverse cut 34 which is open toward the outside of that plate 16.

Figure 4:
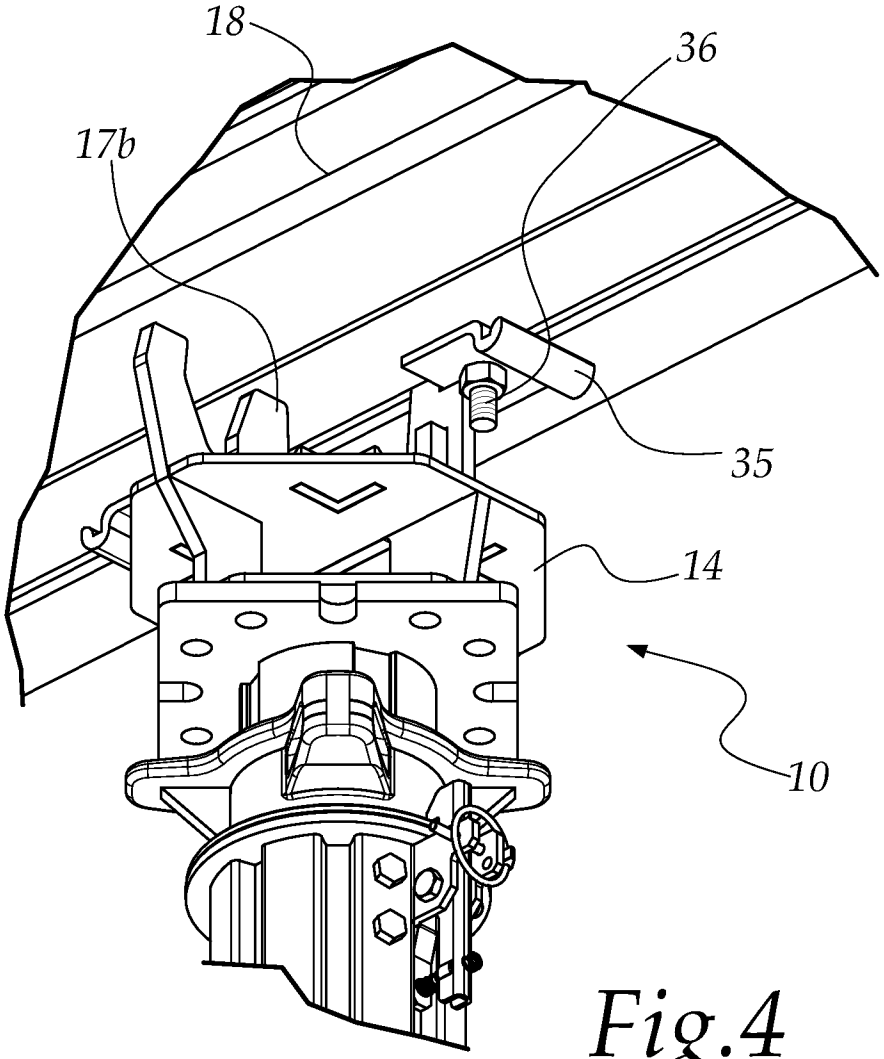
FIG. 4 shows an enlarged detail of FIG. 3.
Figure 3:
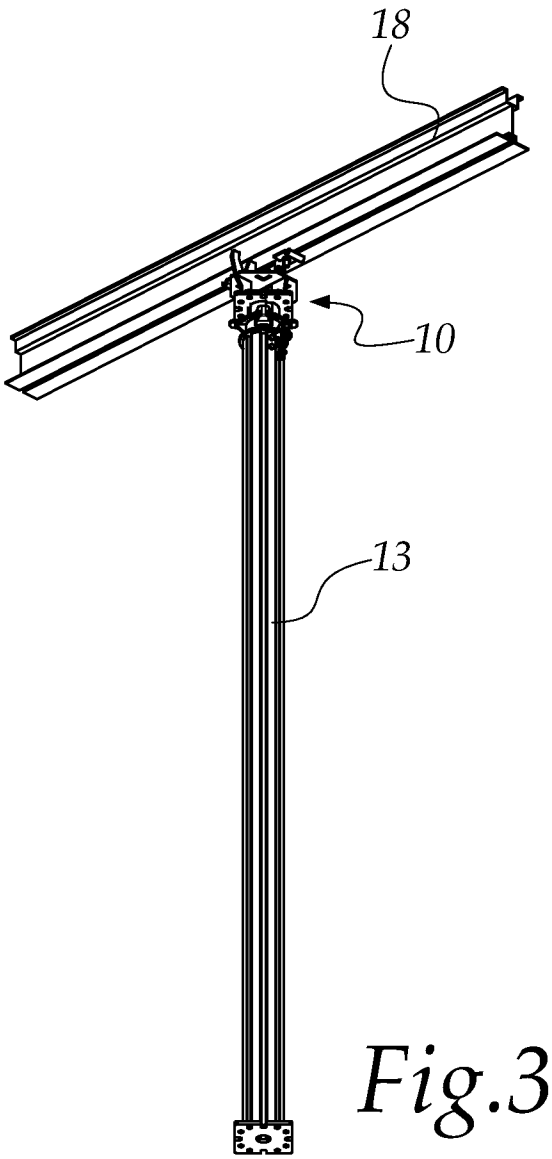
FIG. 3 shows the use of a supporting head according to the invention in supporting a beam.
Figure 5:
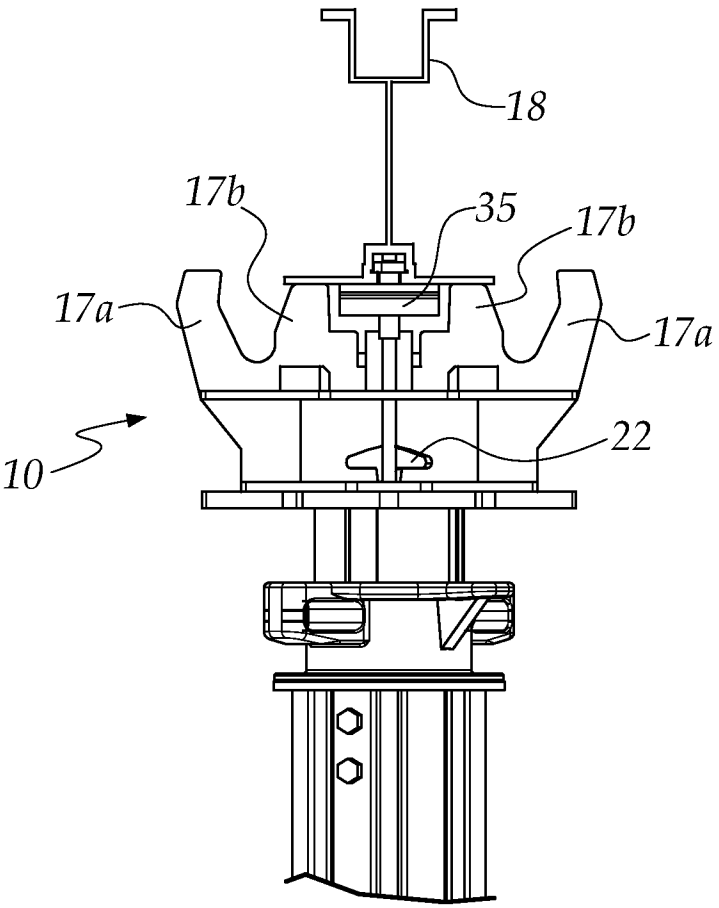
FIG. 5 shows the head as in FIG. 3 again and in a side view.

FIG. 3 shows the supporting head 10 with a first type of supporting beam 18, I-shaped in cross-section. FIG. 4 shows an enlargement of this, while FIG. 5 shows it in a side view. From these figures it is evident that the beam 18 comes to rest on the wings of the base of the beam 18 on the second pair of protrusions 17*b* and also that it is fixed with adapted brackets 35, on opposite sides of the head 10, at the transverse cuts 34 on the second plate 14. In particular, the brackets 35 are inserted into the transverse cuts 34 and locked to the beam 18 with bolts 36.

Figure 6:
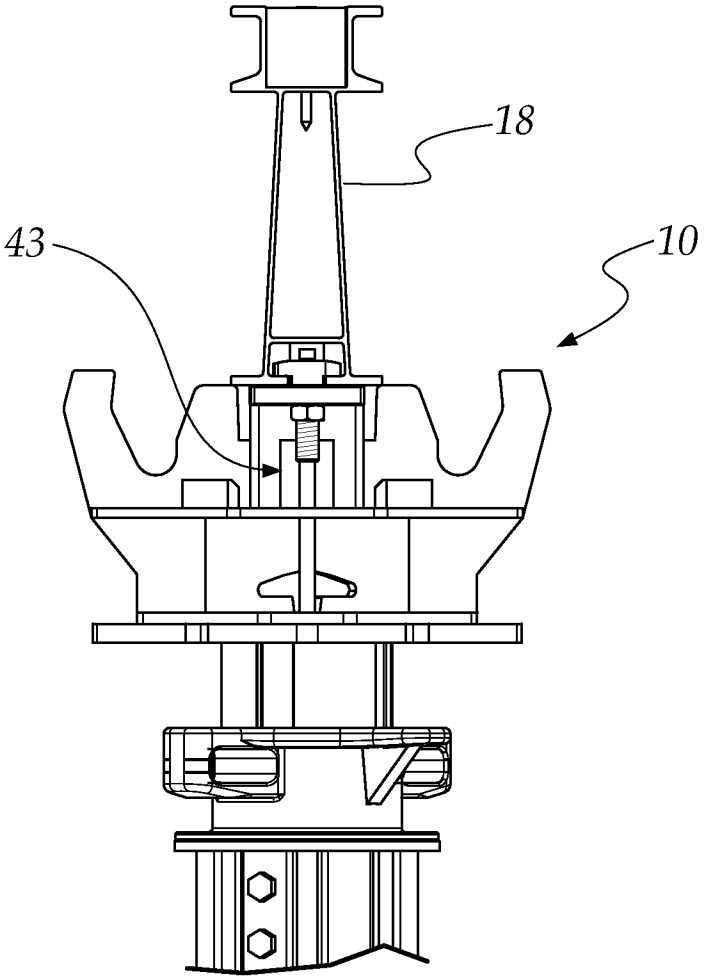
FIG. 6 is a side view of the head according to the invention supporting another beam.

Another example of application is shown in FIG. 6, where another type of beam 18 is placed on and fixed to the supporting head 10, using in addition an adapter element 43, described below, as well as brackets and bolts.

These beams 18 are supported by the supporting head 10 at an intermediate region thereof.

Figure 7:
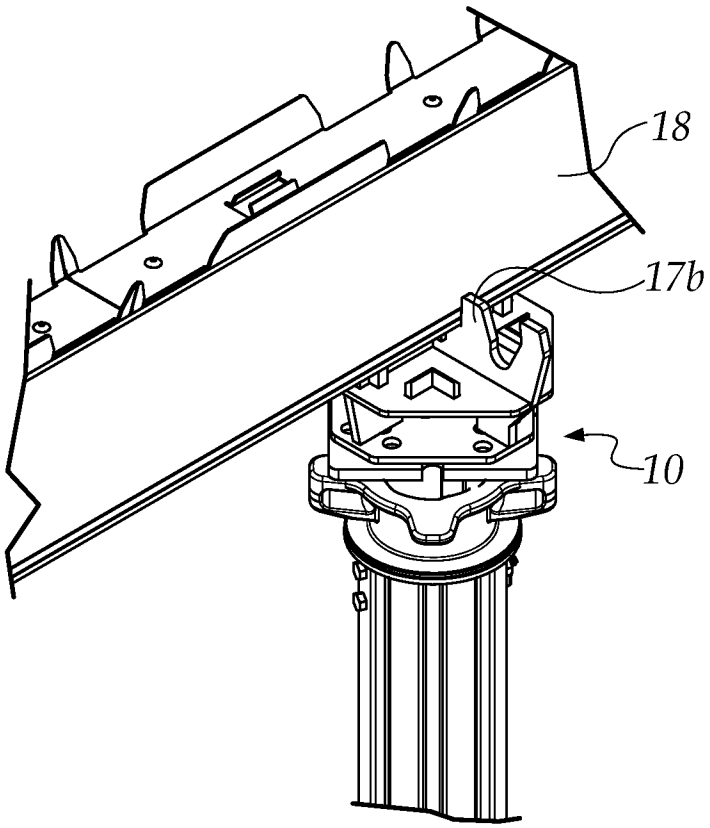
FIG. 7 is a perspective view of the head according to the invention used as an intermediate support for a supporting beam of formwork panels.

The supporting beam 18 of FIG. 7 is also supported in an intermediate region. In this case, the resting region 40 for the beam 18 is the region defined between the second pair of protrusions 17*b*. The pair of protrusions 17*c* of the second plate 16 are inserted into adapted slots below the beam 18, which is conventional per se.

Such beam 18 comprises a profiled element, at the ends of which there is a pair of plate-like elements 38 which are parallel on a vertical plane, with respect to the installation position of the beam 18 itself, between which there is a transverse rod 39 with which the beam 18 is rested on a resting region 40 of the first plate or of the second plate, 15 or 16.

Figure 8:
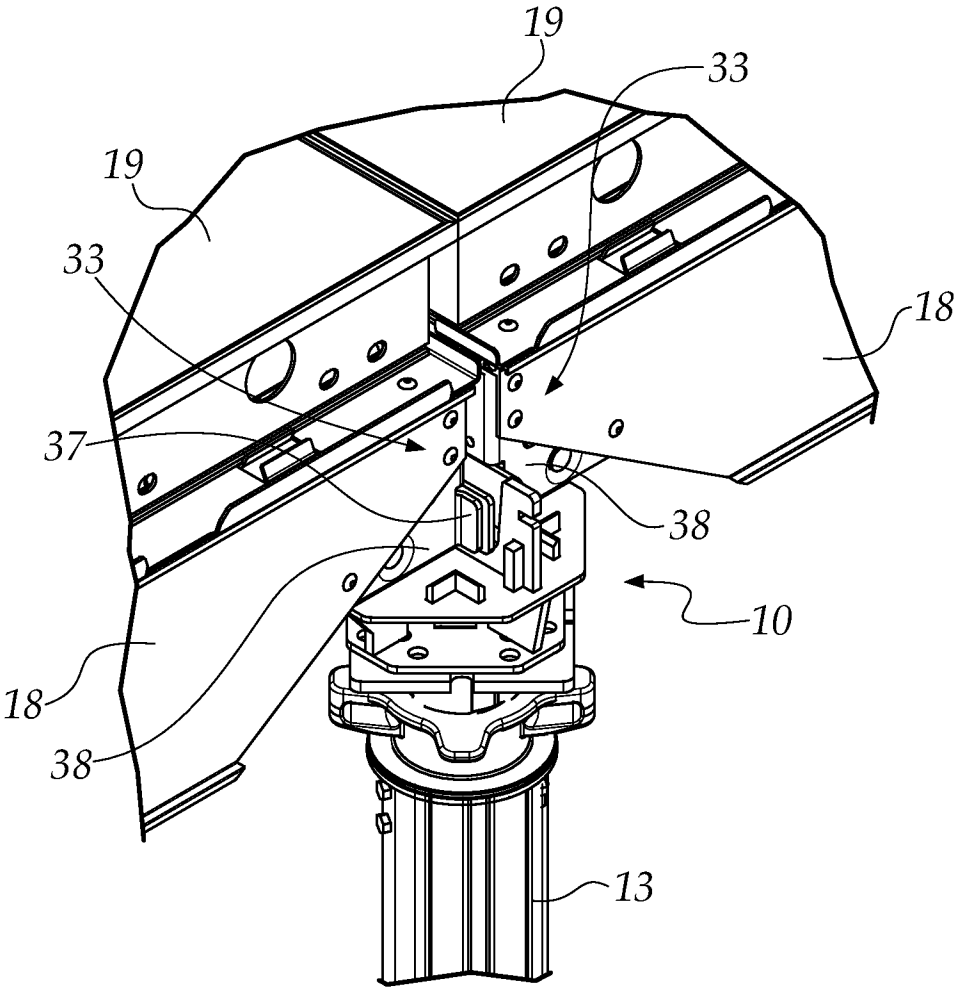
FIG. 8 is a perspective view of the head according to the invention used to support the ends of a pair of supporting beams with formwork panels.

FIG. 8 shows the same beam 18 as the previous figure, with the resting portion 33, an end portion, on the supporting head 10.

In particular, two mutually opposite recesses 32, in this case the ones on the first plate 15, define guide regions (and resting regions 40) for inserting the resting portions 33 of the beam 18. Even more specifically, each beam 18 is rested, on one half of the first plate 15, with the transverse rod (not visible here) present proximate to the end of the beam 18 in the respective recess 32, while the protrusion 17*b* acts as an abutment for a transverse plate 37 present at the end of that beam 18. The protrusion 17*a* is inserted between the two plate-like elements 38.

The same figure also shows panels 19 mounted above the beams 18. Note that the two beams are installed contiguously and close enough together to ensure the contact of the edges of the overlying and contiguous panels.

Each panel 19 has at least one opening in the lower part which is adapted to receive upper portions, in relief, of beams 18 or of the supporting head 10. In particular, the panel 19 is made up of an upper end of wood and of a perimetric profile that defines a box open downward.

Figure 10:
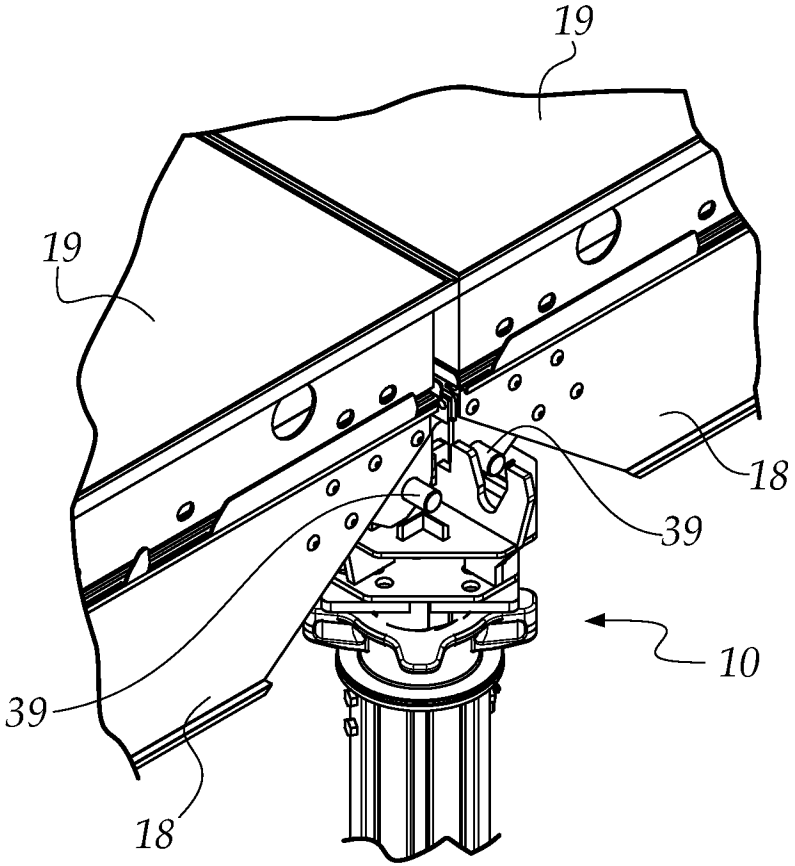
FIG. 10 is a perspective view of the head according to the invention used to support the ends of a pair of supporting beams with formwork panels.
Figure 9:
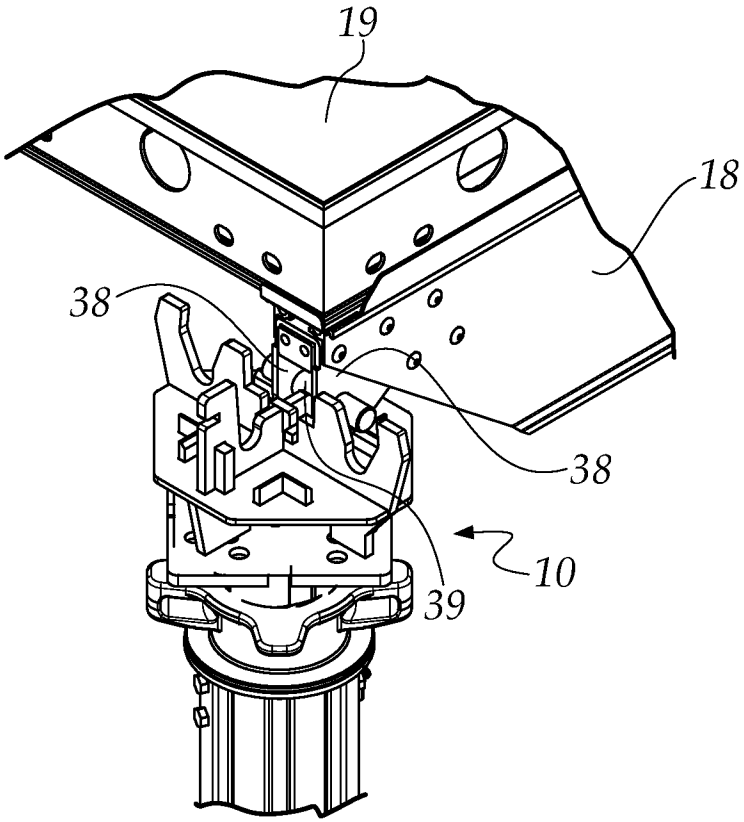
FIG. 9 shows the head according to the invention used to support the ends of a beam with formwork panel.
Figure 11:
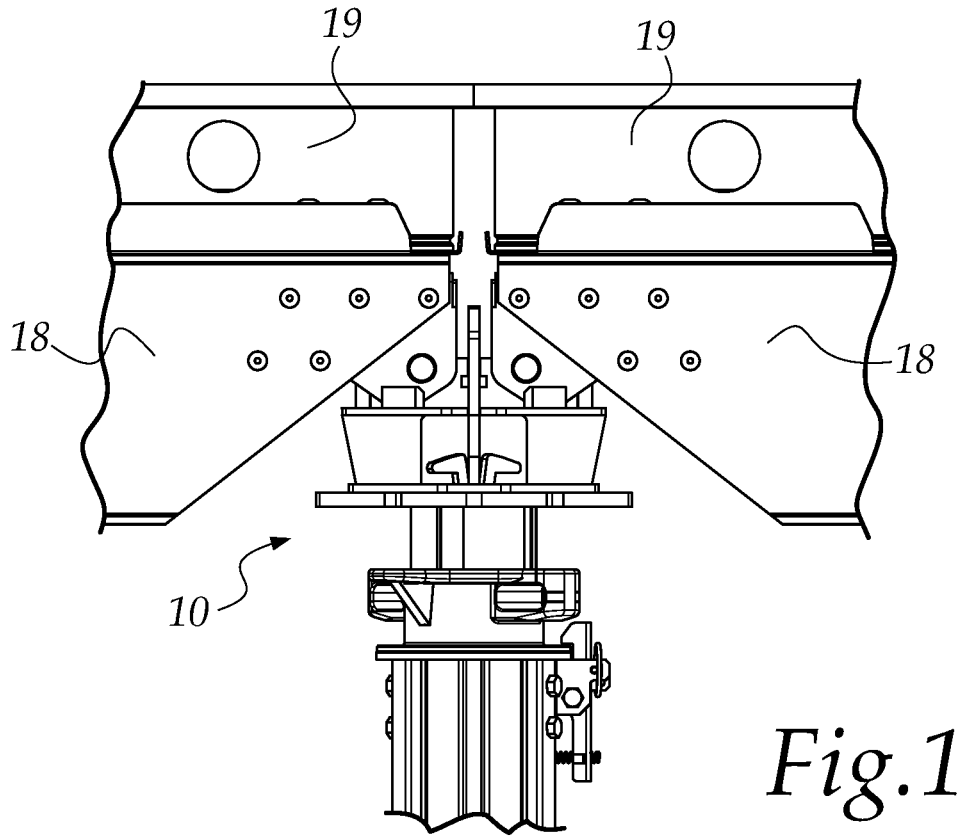
FIG. 11 is a side view of the head as in FIG. 10.

FIGS. 9, 10 and 11 are perspective and front elevation views of the installation of beams 18 on the supporting head 10. In FIG. 9, which shows a corner of the formwork, a single beam 18 can be seen resting on the supporting head 10, with details not visible on the side shown in the subsequent FIGS. 10 and 11, in which the head 10 supports two contiguous horizontal beams, with overlying panels 19 in order to provide a horizontal formwork.

The beam 18 is of the same type as previously, for supporting formwork panels 19, in this case lacking the transverse plates at the ends. The resting occurs as previously described, with transverse rods 39, between respective pairs of plate-like elements 38, on the resting regions 40 of the recesses 32.

In this configuration the beams, without the transverse plates at the ends, can be rested contiguous and inclined at their ends on the supporting heads 10, in order to provide a formwork that is inclined with respect to the horizontal plane, sufficiently close together so as to ensure in this case also the contact of the edges of the overlying and contiguous panels.

Figure 12:
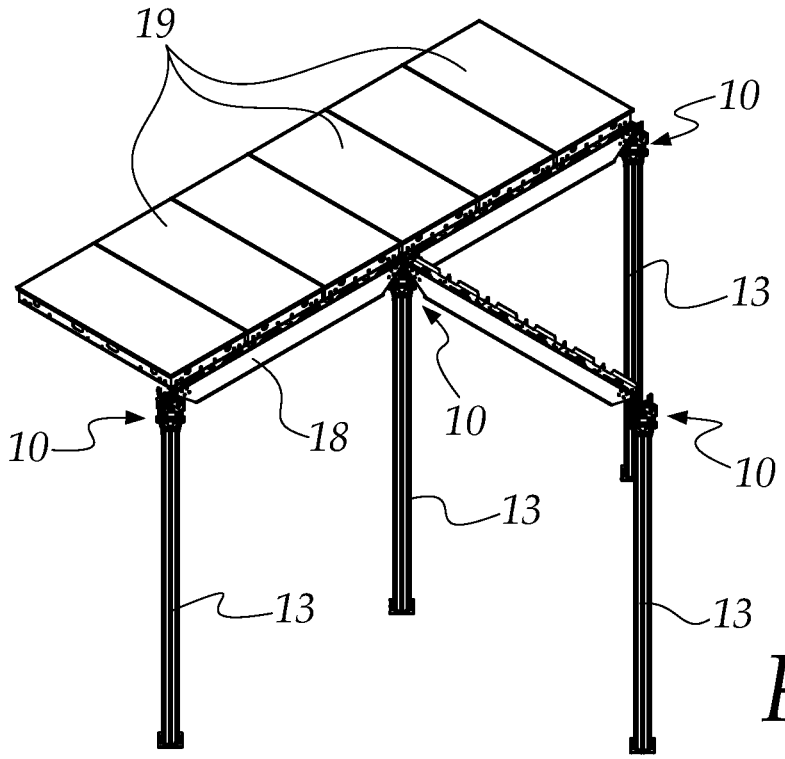
FIG. 12 is a perspective view showing the use of the head according to the invention to support three supporting beams for panels.
Figure 13:
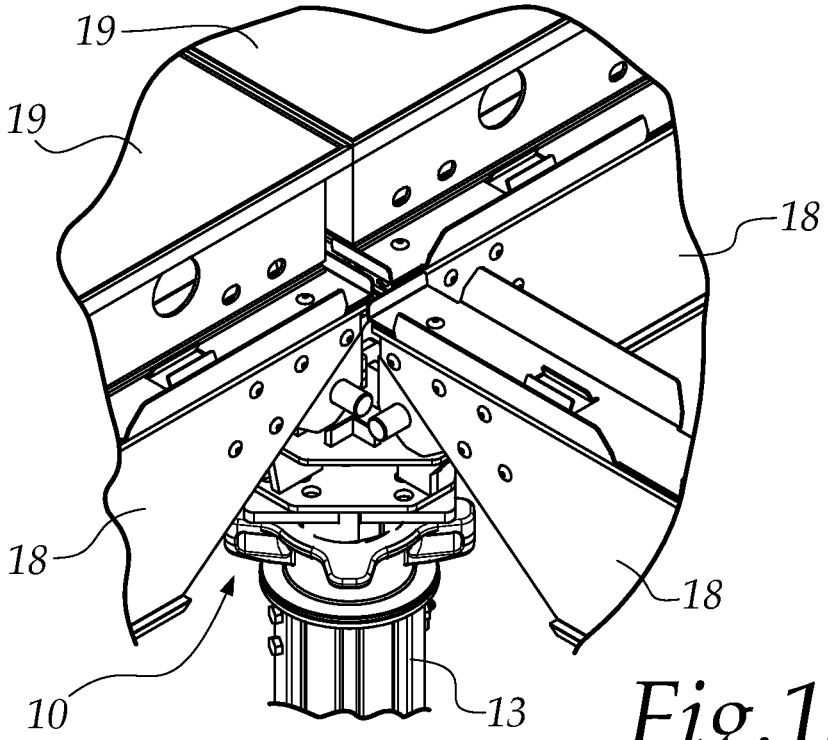
FIG. 13 shows an enlarged detail of FIG. 12.

The supporting head 10 according to the invention further allows the resting of the ends of four beams 18 arranged in a cross, again in the manner described previously, on the resting regions 40 defined by the recesses 32. It is therefore possible to provide a framework of beams 18, including with T-junctions, like that shown in FIG. 12 and in the enlargement of FIG. 13, for example in order to change the direction of the framework of the panels for the floor slab, using only one head.

In this case too, the beams have no transverse plates at the ends, and this also allows, in addition to the possibility of providing inclined formwork units, the installation of beams arranged in a cross: a pair of contiguous beams with ends close together, resting on the recesses 32 of the second plate 16, and a third beam 18 (or another pair of beams), with their ends close together and positioned along the direction perpendicular to that defined by the previous beams and such as to ensure the contact between the edges of the overlying panels.

In the cases described above for beams resting at their ends, the recesses make it possible to hang the beam at one end during assembly, while waiting to be placed with the other end on another head at the top of another prop.

The first plate and the second plate 15 and 16 arranged in a cross define four sectors 41 of the upper plate 14, on at least one of which there is a prominence 42 which protrudes upward.

These are indicated in FIG. 1 and in FIG. 2.

The prominences 42 are L-shaped and are defined by four elements of such shape, welded to the upper plate 14 at respective openings from which they protrude upward.

Figure 14:
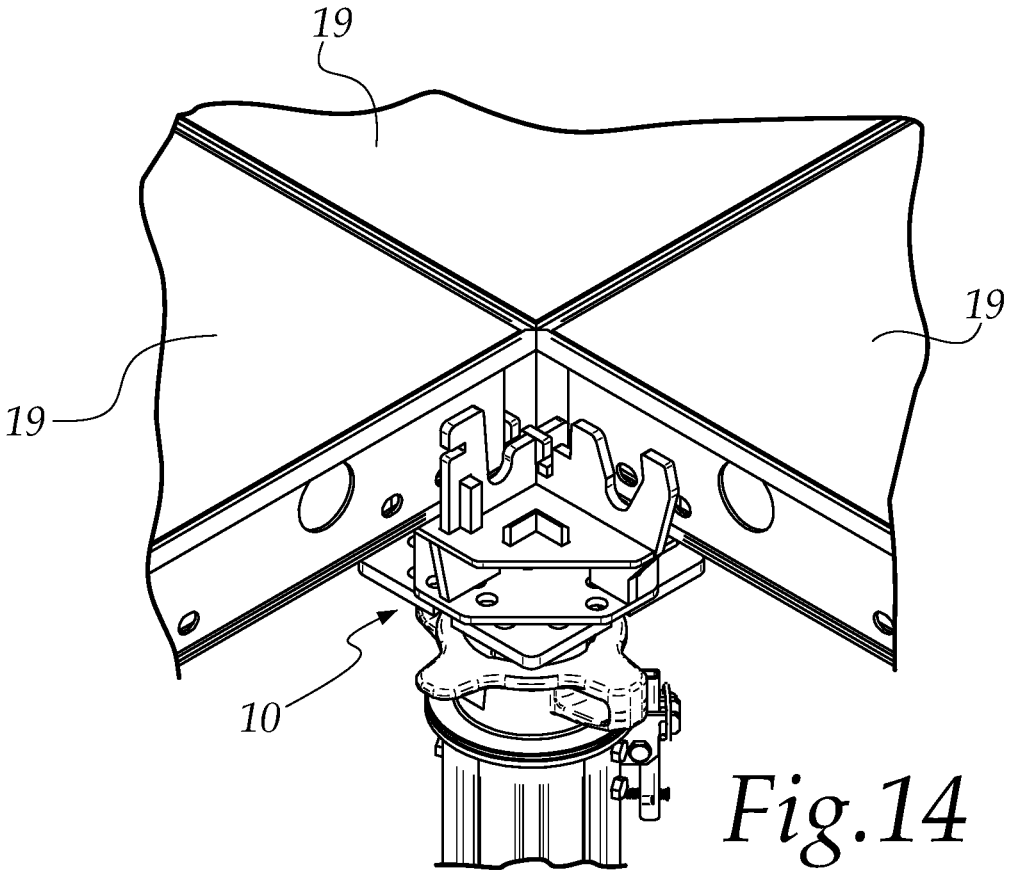
FIG. 14 is a perspective view of the head according to the invention used to directly support formwork panels.
Figure 15:
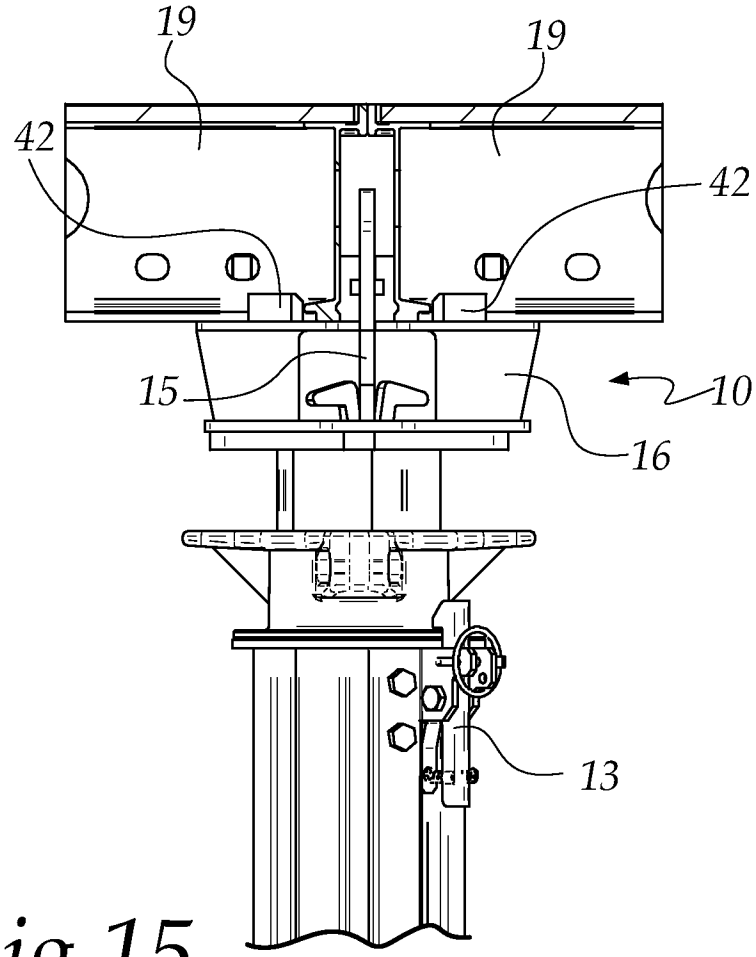
FIG. 15 is a side view of the supporting head as in FIG. 14.

On them, at each sector 41, a respective panel 19 can be rested directly on the supporting head 10 according to the invention, without the interposition of supporting beams, as shown in FIG. 14 and in FIG. 15. This makes it possible to provide a slab deck for casting a floor slab using only the panels, for example for compensations near a wall.

In FIG. 15 it can be seen that the prominences 42 are inserted in adapted seats below the panels 19, thus preventing their displacement.

Figure 16:
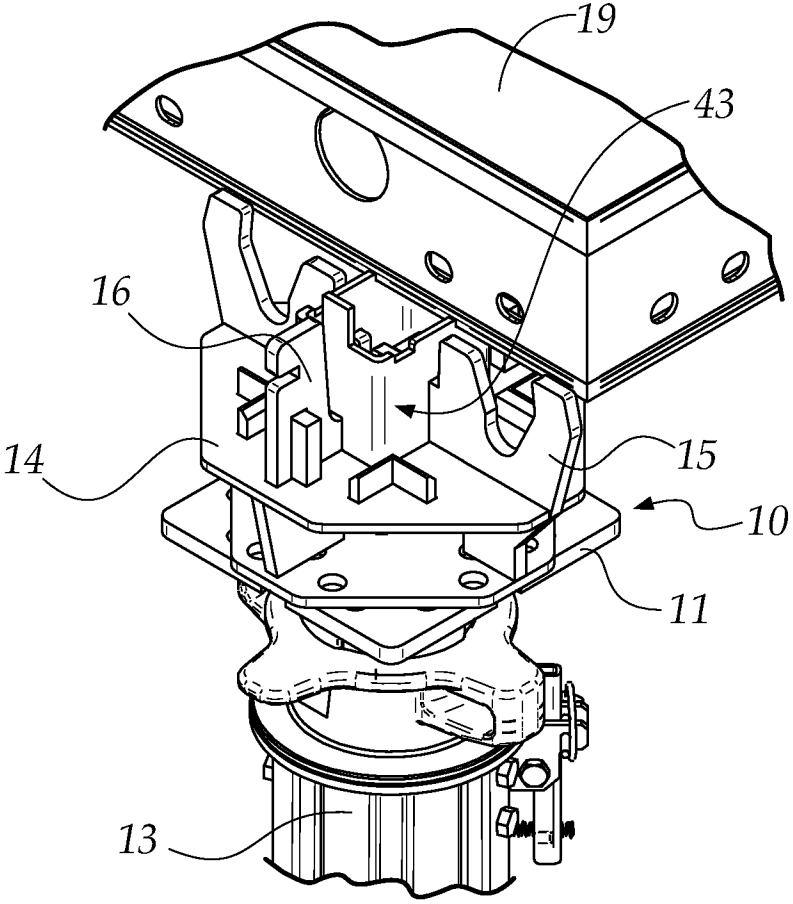
FIG. 16 is a perspective view of the head according to the invention used to support formwork panels according to another configuration.
Figure 17:
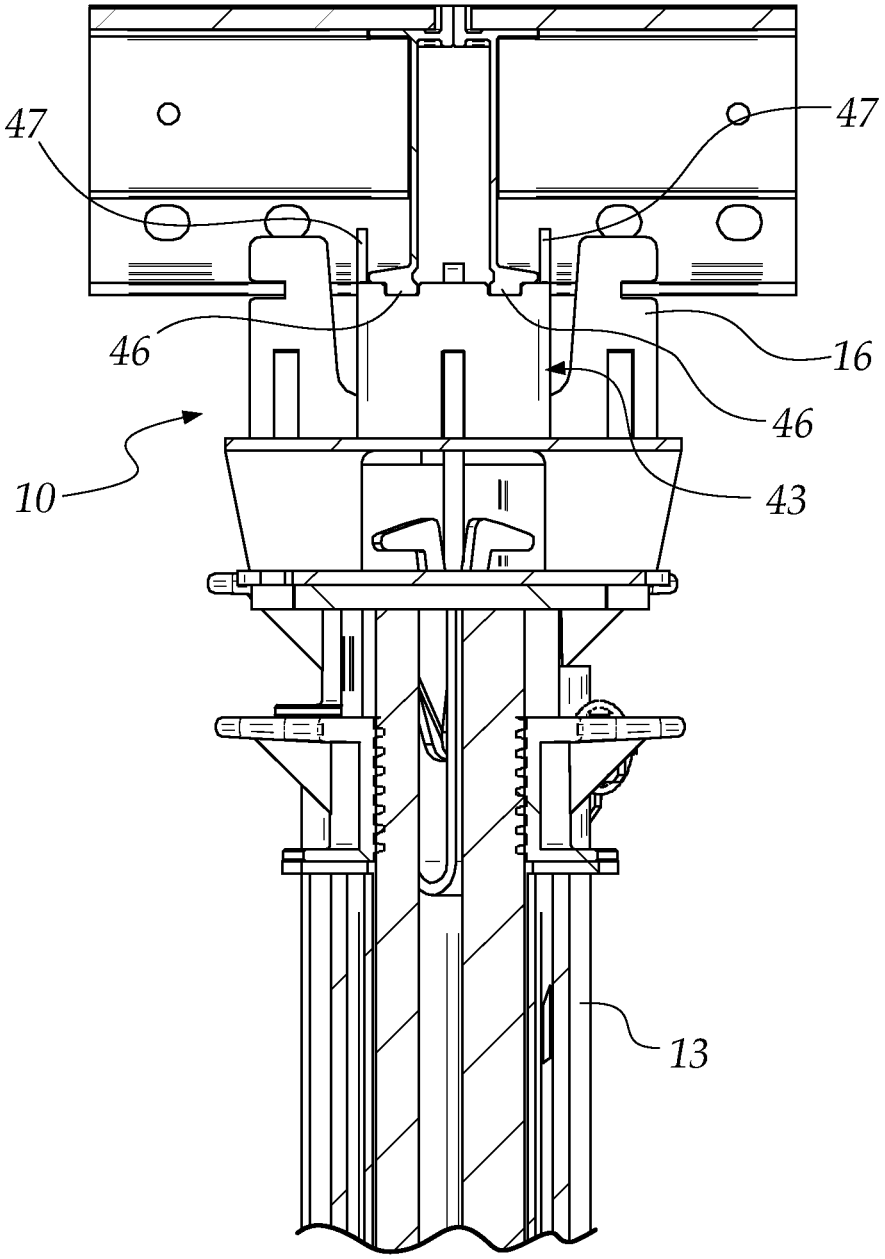
FIG. 17 is a side view of the supporting head as in FIG. 16.

The supporting head 10 can advantageously also comprise a tubular adapter element 43, shown in FIG. 1 and in its application in FIG. 6, in FIG. 16 and in FIG. 17, to be interlocked in an upper region with the first plate and the second plate 15 and 16 and having additional resting regions 40 for at least one panel 19.

The adapter element 43 is quadrangular in cross-section and has, on each wall thereof, a cut 44 which is open from below, with respect to its installation position, and is suitable for the insertion of a respective portion of the first plate 15 or of the second plate 16.

On the top of two opposite walls, the adapter element 43 has seats 45 which define further resting regions 40 for the panels 19. There are complementarily-shaped prominences 46 below the panels which are positioned in the seats 45, as shown in FIG. 17.

In a second embodiment thereof, the supporting head is generally designated by the reference numeral 110 and for it reference will now be made to FIGS. 18 to 21.

In this case, the supporting head 110 comprises, with respect to its position for use:

- a substantially horizontal lower plate 11,
- an upper plate 14 which is parallel to the lower plate 11 and spaced apart therefrom,
- a first plate 15 and a second plate 16, which are arranged in a cross and protrude upward from the upper plate 14 with pairs of vertical protrusions 17*a*, 17*b*, 17*c* which are adapted to define and/or delimit resting regions 40 for supporting beams 18 and/or for panels 19.

A substantial difference between the first embodiment of the supporting head 10 and this second embodiment 110 lies in the fact that in this second embodiment the upper plate 14 is held in a load-bearing configuration by reversible locking means 50 which make it possible to bring the supporting head 110 from a dismantling configuration (FIG. 21) to an erecting configuration (FIG. 20), and vice versa, with lifting of the upper plate 14, which bears the first plate 15 and the second plate 16.

To this end, the reversible locking means 50 comprise a locking plate 51 which is arranged so as to translate on a post 52 below a support 53 for the upper plate 14 and is adapted to support such support 53. The locking plate 51, the shape of which is clearly visible in FIG. 19, has a central window 54 of which a first part 54*a* is of width such as to allow it to slide on the post 52 and a second part 54*b* is provided with internal wedge-shaped prominences 55 for sliding inside two corresponding guiding and locking recesses 56 provided on the post 52.

The wedge-shaped prominences 55 are longitudinal, facing each other and symmetrical, and are wedge-shaped in the direction of the thickness of the locking plate 51, with a height that decreases from the outermost edge of the second part 54*b* of the central window 54, where they have a first height, toward the first part 54*a*, where the height of the end of the wedge-shaped prominences is smaller.

The two guiding and locking recesses 56 are each constituted by an opening provided on the post 52, such opening extending until it also affects the connecting corner regions between two contiguous faces of the post 52.

In this manner the resting and abutment surface for the corresponding prominences 55 is such as to enable a stable locking and at the same time a sufficient load capacity for requirements.

The guiding recesses 56 extend with an inclination with respect to a plane parallel to the lower plate 11. Such inclination is the same as that of the prominences 55. In this manner, the sliding of the wedge-shaped prominences 55 in the respective recesses 56 occurs so that the locking plate 51 remains parallel to itself.

Furthermore, with respect to the first embodiment, in this case the two plates, first 15 and second 16, are arranged vertically and welded to a horizontal plate 57, which is in an intermediate position between the lower plate 11 and the upper plate 14. Between this and the upper plate 14 there is a tubular portion 58 on the intersection between the two plates, first 15 and second 16. In this embodiment these two plates are welded in a downward region on the horizontal plate 57 and around the tubular portion 58. The horizontal plate 57, the tubular portion 58 and the lower portion of the first plate 15 and of the second plate 16 provide the support 53.

The post 52 and the tubular portion 58 are constituted by tubular elements with a quadrangular cross-section.

The support 53 is designed to be fixed to the lower plate 11 by virtue of the coupling of an upper part of the post 52, which is welded to the lower plate 11 in a substantially central region, in the tubular portion 58. The two are fixed with a pin 59.

The post 52 has two plates 60, on two opposite sides thereof, on which the locking plate 51 is adapted to abut in the dismantling configuration.

Figure 18:
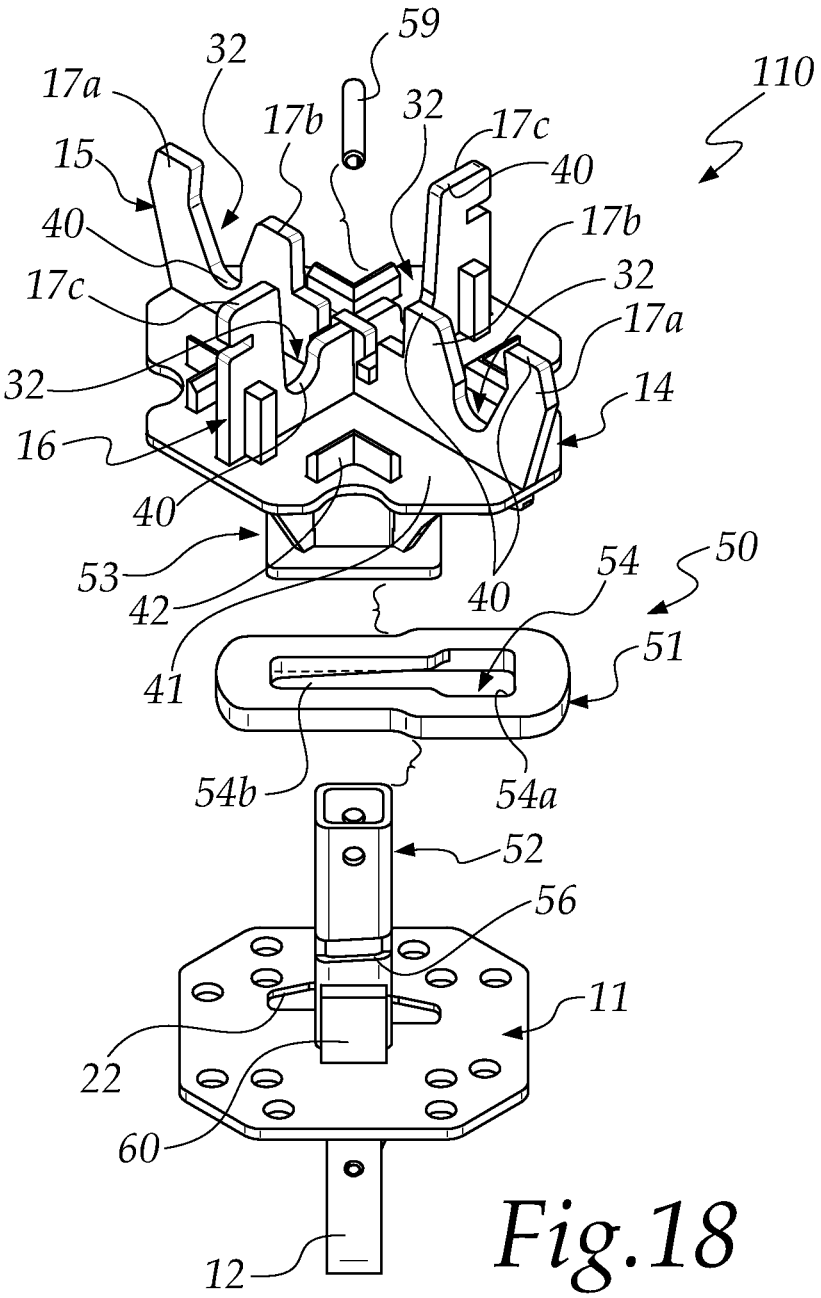
FIG. 18 is a partially exploded perspective view of a supporting head according to the invention, in a second embodiment thereof.
Figure 19:
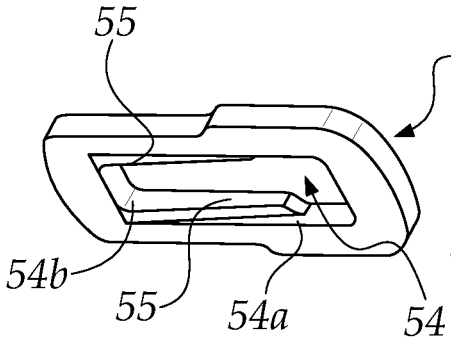
FIG. 19 is a perspective view of an element of the locking means of the supporting head.
Figure 21:
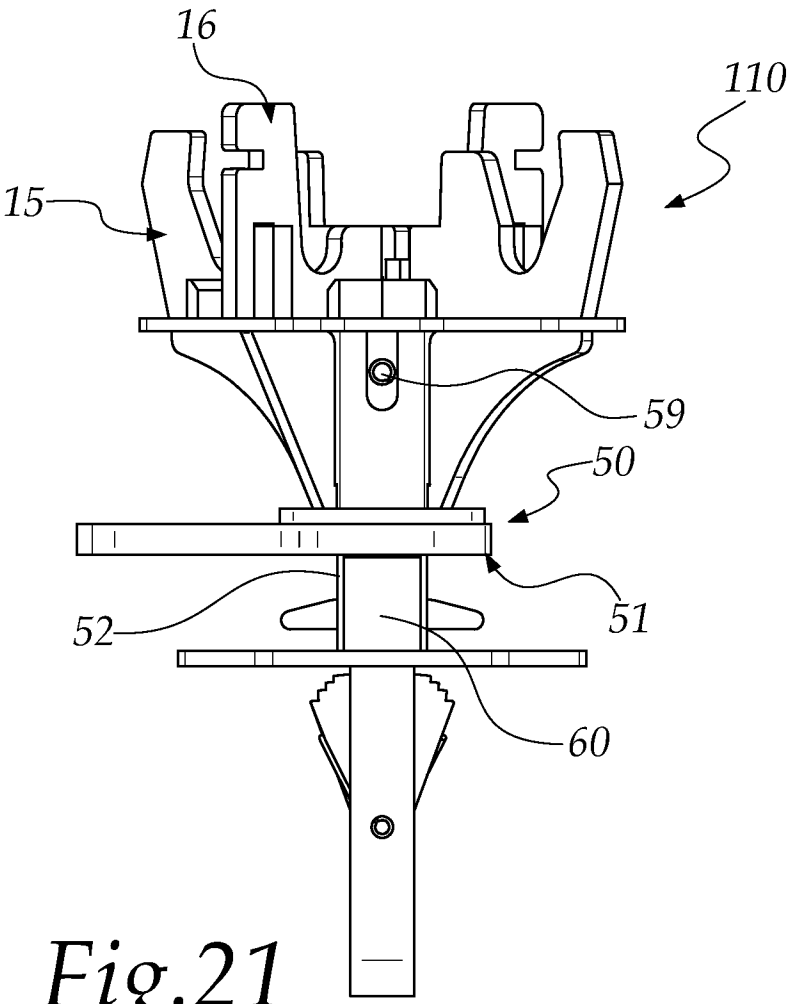
FIG. 21 is a side view of the supporting head during the step of dismantling.
Figure 20:
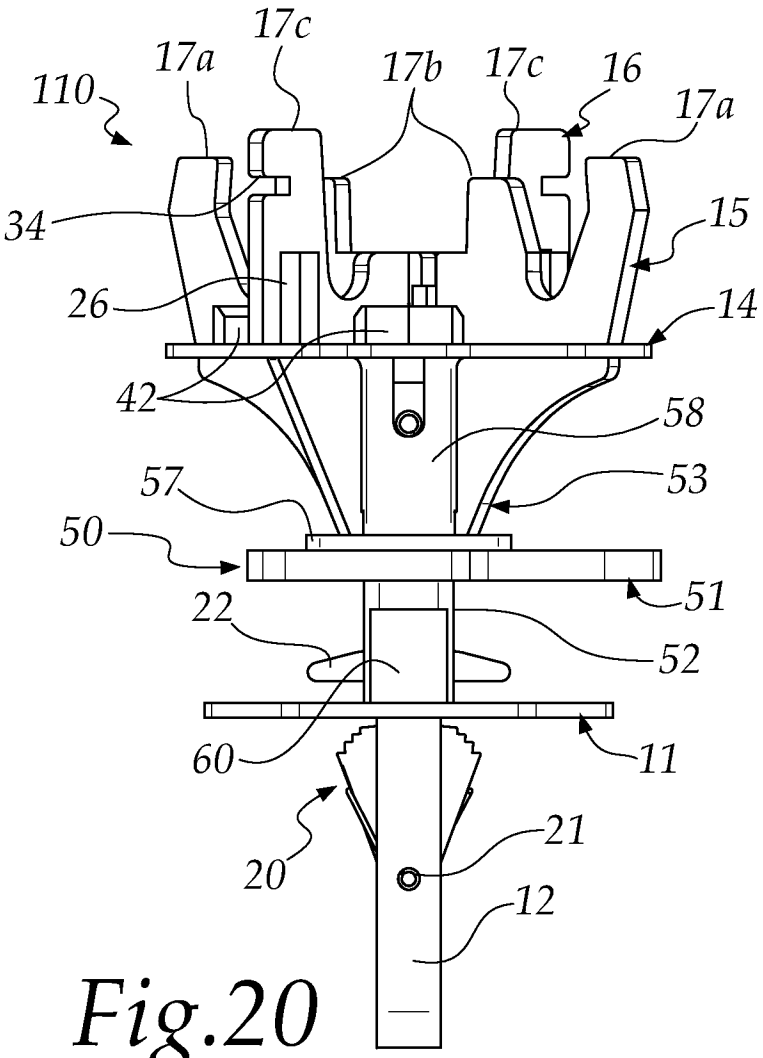
FIG. 20 is a side view of the supporting head during the step of erecting.

The other elements of the supporting head 110, not cited, correspond to the elements already described for the first embodiment and are at least partially numbered in FIGS. 18, 20 and 21.

In this embodiment, the release of the supporting head is facilitated. FIG. 20 shows it in the erecting configuration, in which the wedge-shaped prominences 55 are forced into the respective recesses 56. In order to obtain this configuration it is necessary to make the locking plate translate, on the construction site, using hammer blows or another, similar tool. The operation to dismantle and therefore release the supporting head 110 occurs by striking the locking plate 51, in the opposite direction, so as to induce a translation thereof to make the wedge-shaped prominences 55 protrude from the recesses 56, until the configuration shown in FIG. 21 is obtained: since the first part 54*a* is wide enough to allow the sliding of the plate 51 on the post 52 but still narrower than the transverse dimension of the latter in the region that comprises the two plates 60, the egress of the wedge-shaped prominences 55 from the recesses determines the lowering of the locking plate 51 with abutment, in the first part of the window 54*a*, on the two plates 60. The lowering is preferably by approximately 1 cm and has a knock-on effect on the upper part, therefore it entails a lowering also of the support 53, which rests on the plate 51, and therefore of the two plates, first 15 and second 16, in order to facilitate the dismantling, by detaching from the beams and/or from the panels resting on the head.

At the top of each one of the other two opposite walls, the adapter element 43 has an appendage 47 with which it is adapted to be inserted into adapted slits below the respective panel 19 resting upon it.

It is also evident that the presence of reversible locking means facilitates the locking of the supporting head in the erecting configuration and also facilitates the release thereof for the dismantling.

Use of the supporting head according to the invention is evident from the foregoing description and explanation and, in particular, it is evident that the shape of the plates and of the adapter element define a plurality of stable resting regions for beams and for panels.

In practice it has been found that the invention fully achieves the intended aim and objects by providing a supporting head that can be used for supporting beams of different types, in an intermediate position or at the ends, along a horizontal or inclined direction or to directly support formwork panels and in any case without leaving empty spaces between the contiguous panels.

The invention, thus conceived, is susceptible of numerous modifications and variations, all of which are within the scope of the appended claims. Moreover, all the details may be substituted by other, technically equivalent elements.

In practice the materials employed, provided they are compatible with the specific use, and the contingent dimensions and shapes, may be any according to requirements and to the state of the art.

The disclosures in Italian Patent Application No. 102020000031187 and in Italian Patent Application No. 102021000029789 from which this application claims priority are incorporated herein by reference.

The invention claimed is:

1. A supporting head for providing formwork units for floor slabs, comprising, with respect to a position for use thereof:

a substantially horizontal lower plate, an upper plate which is parallel to said lower plate and spaced apart therefrom, a first plate and a second plate, which are arranged in a cross and protrude upward from said upper plate with pairs of vertical protrusions which are adapted to define and/or delimit resting regions for supporting beams and/or for panels wherein each one of said vertical protrusions of said second plate has a transverse cut open toward an outside of said plate and closed toward a center of said plate.

2. The supporting head according to claim 1, wherein said upper plate is rendered integral with said lower plate.

3. The supporting head according to claim 1, wherein said upper plate is held in a load-bearing configuration by reversible locking means which make it possible to bring said supporting head from a dismantling configuration to an erecting configuration, and vice versa, with lifting of said upper plate, which bears said first plate and second plate.

4. The supporting head according to claim 3, wherein said reversible locking means comprise a locking plate which is arranged so as to translate on a post below a support for said upper plate and is adapted to support said support, said locking plate having a central window of which a first part is of width such as to allow it to slide on said post and a second part is provided with internal wedge-shaped prominences for sliding inside two corresponding guiding and locking recesses provided on the post.

5. The supporting head according to claim 1, wherein said pairs of vertical protrusions have a flat upper edge on which to rest said supporting beams.

6. The supporting head according to claim 1, wherein said first plate has a first pair of said pairs of vertical protrusions, which are mutually opposite so as to delimit between them a said resting region for a said supporting beam, and a second pair of said pairs of vertical protrusions, which are more external than said first pair of vertical protrusions, so as to define therewith mutually opposite recesses for guiding insertion of respective resting portions of corresponding said supporting beams.

7. The supporting head according to claim 1, wherein said second plate has a pair of mutually opposite recesses which are delimited externally by a pair of said vertical protrusions for guiding insertion of respective resting portions of corresponding said supporting beams.

8. The supporting head according to claim 1, wherein said first plate and said second plate arranged in a cross define four sectors of said upper plate, on at least one of said four sectors there is a prominence which protrudes upward.

9. The supporting head according to claim 1, further comprising a tubular adapter element to be interlocked in an upper region with said first plate and said second plate and having additional resting regions for at least one said panels.

10. The supporting head according to claim 9, wherein said tubular adapter element is quadrangular in cross-section and has, on each wall thereof, a cut which is open from below, with respect to an installation position thereof, and is suitable for insertion of a respective first plate portion or second plate portion.

11. A beam for providing formwork units for floor slabs, to be used with a supporting head according to claim 1, further comprising a profiled element at ends of which there is a pair of plate-like elements which are parallel on a vertical plane, with respect to an installation position of said beam, between which there is a transverse rod with which said beam is rested on a said resting region of one of said first plate and said second plate.

12. A panel for providing formwork units for floor slabs, to be used with a supporting head according to claim 1, having at least one opening in a lower part which is adapted to receive portions of said beam or of said supporting head.

* * * * *